US009522771B2

(12) United States Patent
Yang

(10) Patent No.: US 9,522,771 B2
(45) Date of Patent: Dec. 20, 2016

(54) CONTAINER FOR RECEIVING TWO MATERIALS

(71) Applicant: Fang Lin Yang, Taichung (TW)

(72) Inventor: Fang Lin Yang, Taichung (TW)

( * ) Notice: Subject to any disclaimer, the term of this patent is extended or adjusted under 35 U.S.C. 154(b) by 0 days.

(21) Appl. No.: 14/700,297

(22) Filed: Apr. 30, 2015

(65) Prior Publication Data

US 2016/0318688 A1 Nov. 3, 2016

(51) Int. Cl.

| | |
|---|---|
| ***B65D 81/32*** | (2006.01) |
| ***B65D 23/04*** | (2006.01) |
| ***B65D 41/04*** | (2006.01) |
| ***B65D 25/08*** | (2006.01) |

(52) U.S. Cl.

CPC ..... *B65D 81/32* (2013.01); *B65D 23/04* (2013.01); *B65D 25/087* (2013.01); *B65D 41/0421* (2013.01); *B65D 41/0428* (2013.01); *B65D 41/0485* (2013.01)

(58) Field of Classification Search

CPC ..... B65D 1/04; B65D 23/04; B65D 25/08; B65D 25/082; B65D 25/087; B65D 41/0421; B65D 41/0428; B65D 41/485; B65D 51/2857; B65D 51/2864; B65D 81/32; B65D 81/3283

USPC ..... 206/219, 221; 215/6, DIG. 8

See application file for complete search history.

(56) References Cited

U.S. PATENT DOCUMENTS

| | | | | | |
|---|---|---|---|---|---|
| 3,198,194 | A * | 8/1965 | Wilburn | B65D 25/082 | 206/221 |
| 3,674,028 | A * | 7/1972 | Ogle | A61J 1/2093 | 206/221 |
| 4,180,173 | A * | 12/1979 | Diaz | B65D 25/082 | 215/6 |
| 4,315,570 | A * | 2/1982 | Silver | B65D 81/3222 | 206/221 |
| 4,979,941 | A * | 12/1990 | Ogle, II | A61J 1/2089 | 222/129 |
| 6,089,389 | A * | 7/2000 | Sharon | A61J 9/00 | 215/6 |
| 6,951,275 | B2 * | 10/2005 | Serra Galdos | B65D 25/082 | 206/221 |
| 7,861,854 | B2 * | 1/2011 | Sharon | B65D 51/2864 | 206/221 |
| 8,136,660 | B2 * | 3/2012 | Sharon | B65D 11/04 | 206/221 |
| 9,409,694 | B2 * | 8/2016 | Duncan | B65D 81/3283 | |

(Continued)

*Primary Examiner* — Bryon Gehman

(74) *Attorney, Agent, or Firm* — Ming Chow; Sinorica, LLC

(57) ABSTRACT

A container for receiving two materials includes a main body, a controlling member, and a bottle cap. The main body has a head segment, a body segment connected to the head segment and a neck segment formed therebetween. The controlling member has a sealing portion to mate with the neck segment to divide the space within the main body into an upper cavity and a lower cavity. The bottle cap is configured to the head segment. An engaging portion is configured on the inner wall of the bottle cap. A connecting portion is standing on the sealing portion, and an engaging groove is defined on the connecting portion to be engaged with the engaging portion. Accordingly, when the bottle cap is rotated, the controlling member is driven to allow the sealing portion detaching from the neck portion, such that the upper cavity communicates with the lower cavity.

10 Claims, 9 Drawing Sheets

(56) References Cited

U.S. PATENT DOCUMENTS

| | | | | |
|---|---|---|---|---|
| 9,409,695 | B2 * | 8/2016 | Carse | B65D 81/3283 |
| 9,409,696 | B2 * | 8/2016 | Carse | B65D 81/3283 |
| 2009/0294397 | A1 * | 12/2009 | Wu | B65D 81/3222 215/6 |

* cited by examiner

CONTAINER FOR RECEIVING TWO MATERIALS

BACKGROUND OF THE INVENTION

Field of the Invention

The present invention relates to a container, and more particularly to a container having two separated cavities and the article in the two cavities can be mixed with each other by operation.

Description of the Prior Art

Most market available bottled beverages are made by mixing several materials with each other prior to filling the materials into the bottles. Therefore, the storage and the freshness of the beverages becomes an issue. In addition, if the materials are mixed improperly during the manufacturing procedures, the beverages would become muddy or have participates. As a result, consumers would hesitate to buy the beverages due to their outlooks. Such a problem is hard to be solved.

Accordingly, a TW Invention Patent No. 1423906 discloses a container having two receiving cavities for respectively receiving two materials. The two receiving cavities are allowed to be in communication with each other prior to drinking. In detail, the body of the container has a waist portion to divide the cavity in the body into an upper cavity and a lower cavity. A partition member is placed in the bottle and mated with the waist portion so as to separate the upper cavity and the lower cavity. Accordingly, the materials inside the two cavities would not be mixed with each other. A bottle cap is combined with the partition member. When a user wants to drink the beverage inside the container, the bottle cap is unscrewed and the partition member is detached from the waist portion upon the bottle cap is unscrewed, such that the upper cavity becomes in communication with the lower cavity, and the materials inside the two cavities are mixed with each other. Consequently, the beverages would be made prior to drinking. As a result, the bottled beverages can be stored longer, and the bottled beverages would not have a muddy outlook or participates when the bottle beverages are placed in the stores.

However, in order to form the two cavities in the bottle, the length of the partition member would have a certain length, but the length of the partition member is too long to allow the user to take the partition member from the waist portion. In addition, the overlengthed partition member would increase the manufacturing cost of the bottled beverage. Besides, after the partition member is detached from the waist portion of the bottle, the bottle cap cannot be screwed onto the bottle easily due to the exposed partition member, resulting in user's inconvenience.

Additionally, after the partition member is detached from the waist portion to allow the communication between the upper cavity and the lower cavity, the bottle cap cannot be provided for screwing the opening of the bottle. As a result, when the user tends to mixing the materials inside the bottle, the beverage inside the bottle would leak to the bottle cap from the space between the partition member and the opening of the bottle, and further leak to outside from the space between the bottle cap and the threaded portion around the opening of the bottle.

Besides, the aforementioned bottle is gourd shaped, and is different from typical market available bottles, such that customers may hesitate to buy the beverage because the different appearance of the bottle.

The present invention is, therefore, arisen to obviate or at least mitigate the above mentioned disadvantages.

SUMMARY OF THE INVENTION

One object of the present invention is to provide a container for receiving two materials. Wherein, a controlling member is configured to divide space within the container into two receiving cavities, respectively defined in the head segment and the body segment. The materials can be mixed with each other via the communication between the two receiving cavities to produce beverage, and the communication is achieved by the control of the controlling member. In the present invention, because the controlling member is locked with the head segment of the bottle and covered by the bottle cap, the outlook of the container according to the present invention is similar to a typical cylindered bottle.

Additionally, the length of the controlling member is about equal to the length of the bottle cap, thereby the manufacturing cost of the bottle can be reduced. Besides, the controlling member can be detached from the head segment much easier as compared with a typical partition member. Moreover, the bottle cap having the controlling member can be adapted to the head segment properly, improving user's convenience.

Furthermore, the inner diameter of the head segment is less than that of the body segment, so the annular portion of the controlling member can be abutted against the inner wall of the head segment easily; while when the controlling member is detached from the head segment and the neck segment, the annular portion would be abutted against the inner wall of the head segment and the inner wall of the bottle cap, so that the beverage would not leak out of the bottle when the bottle is shaken.

To achieve the above and other objects, a container for receiving two materials is provided and comprises a main body, a controlling member, and a bottle cap. The main body defines a receiving cavity therein. The main body has a head segment and a body segment connected to the head segment. A neck segment is formed between the head segment and the body segment. The inner diameter of the neck segment is less than the inner diameter of the head segment and the inner diameter of the body segment. The head segment has a first thread segment configured to the outer periphery thereof. The controlling member has a sealing portion. The outer diameter of the sealing portion is mated with the inner diameter of the neck segment. A connecting portion is standing on the sealing portion. When the sealing portion of the controlling member is mated with the neck segment, the receiving cavity is divided into an upper cavity and a lower cavity. The upper cavity is defined in the head segment, and the lower cavity is defined in the body segment. The bottle cap is configured to the head segment. The bottle cap has a second thread segment configured to the inner wall thereof to be threaded with the first thread segment. An engaging groove is defined on the connecting portion of the controlling member, and an engaging portion is configured on the inner wall of the bottle cap. The controlling member and the bottle cap are combined with each other by the engagement between the engaging groove and the engaging portion. When the controlling member is rotated along with the rotation of the bottle cap, the sealing portion is detached from the neck segment, thereby enabling the communication between the upper cavity and the lower cavity.

In one implementation aspect, the connecting portion of the controlling member has an annular portion, and the outer periphery of the annular portion is abutted against the inner wall of the head segment. The annular portion further comprises an extension segment extending from the head segment, and the engaging groove is defined around the outer periphery of the extension segment.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
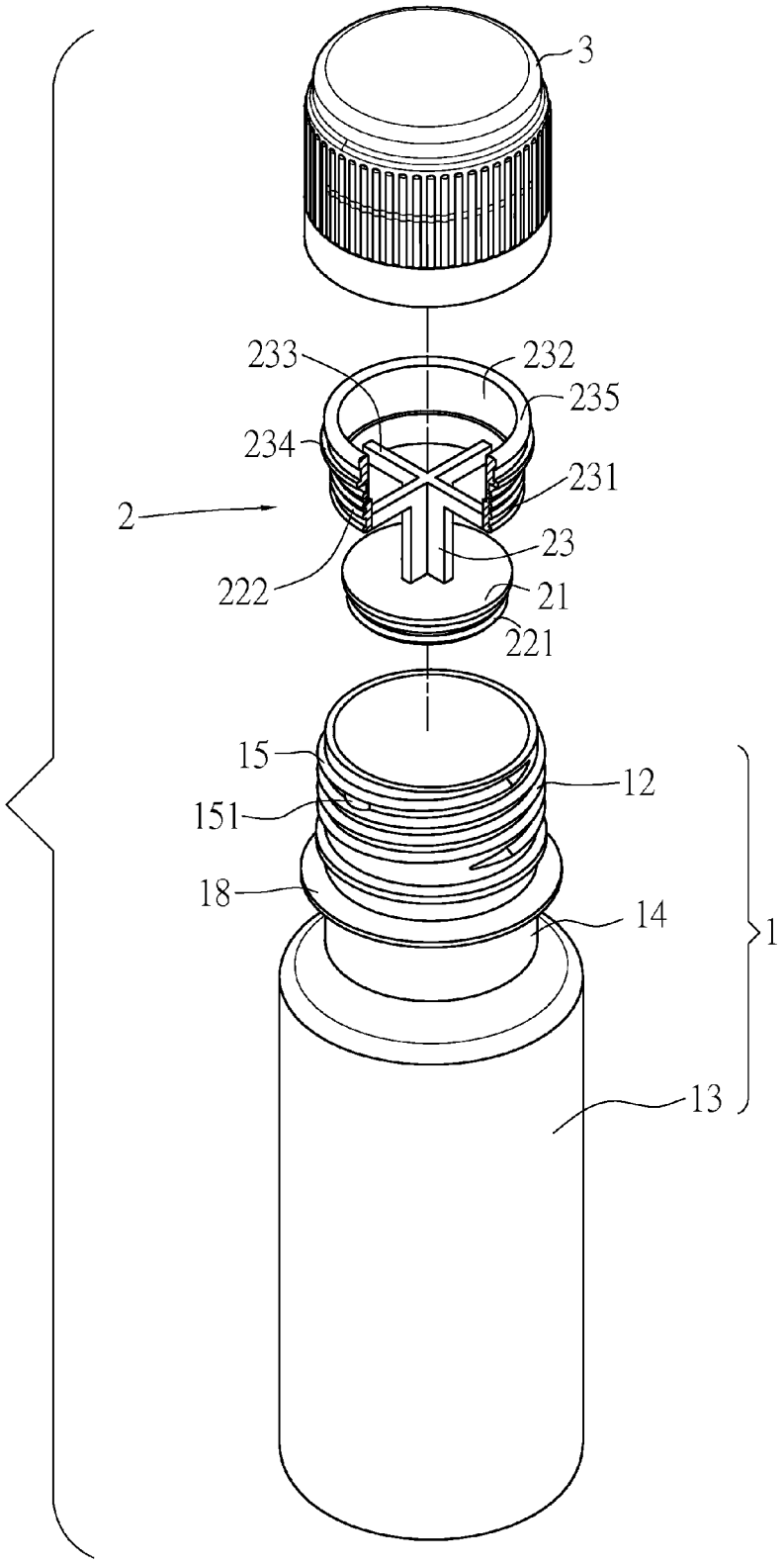
FIG. 1 is an exploded view of a container according to a first embodiment of the present invention.
Figure 2:
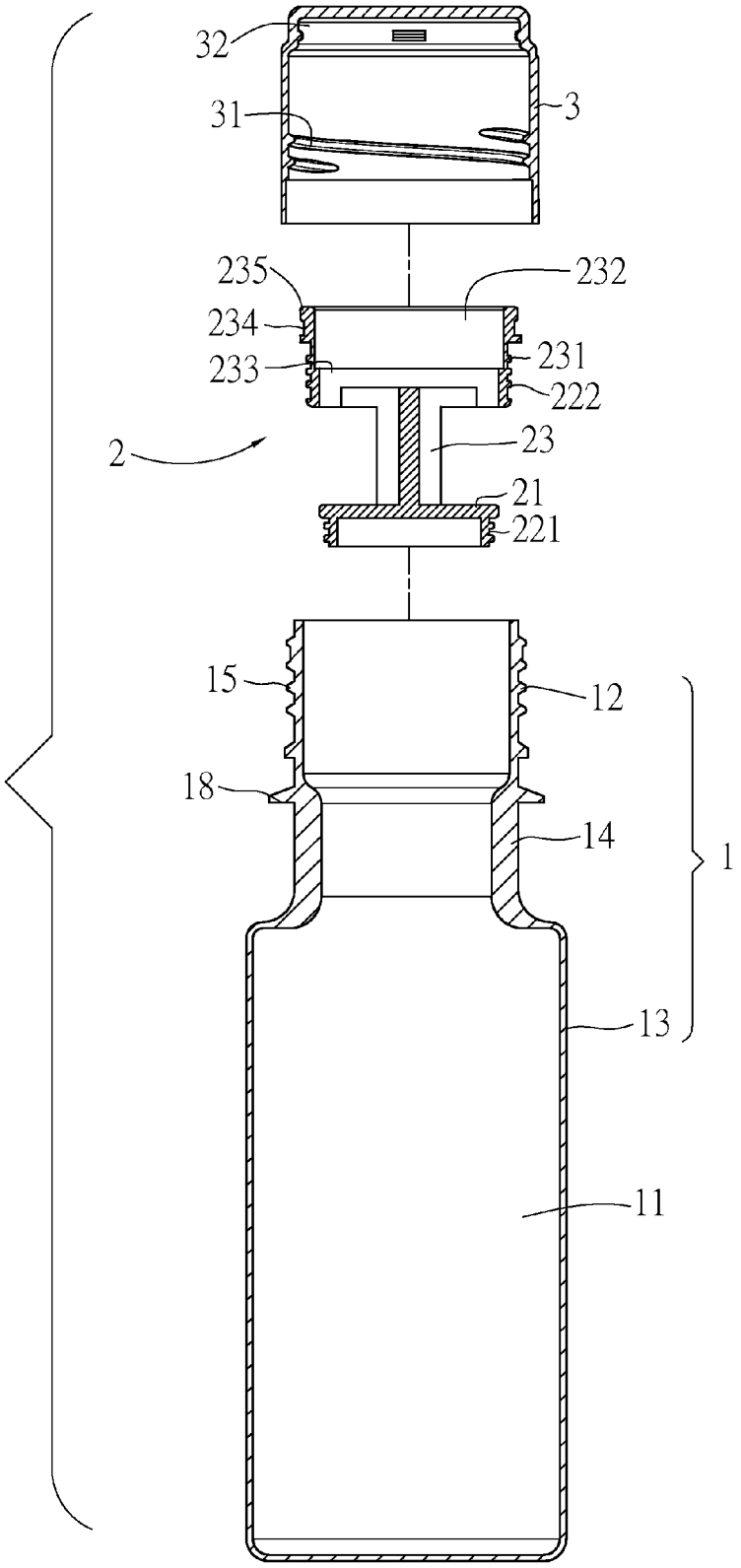
FIG. 2 is a sectional exploded view of the container according the first embodiment of the present invention.
Figure 3:
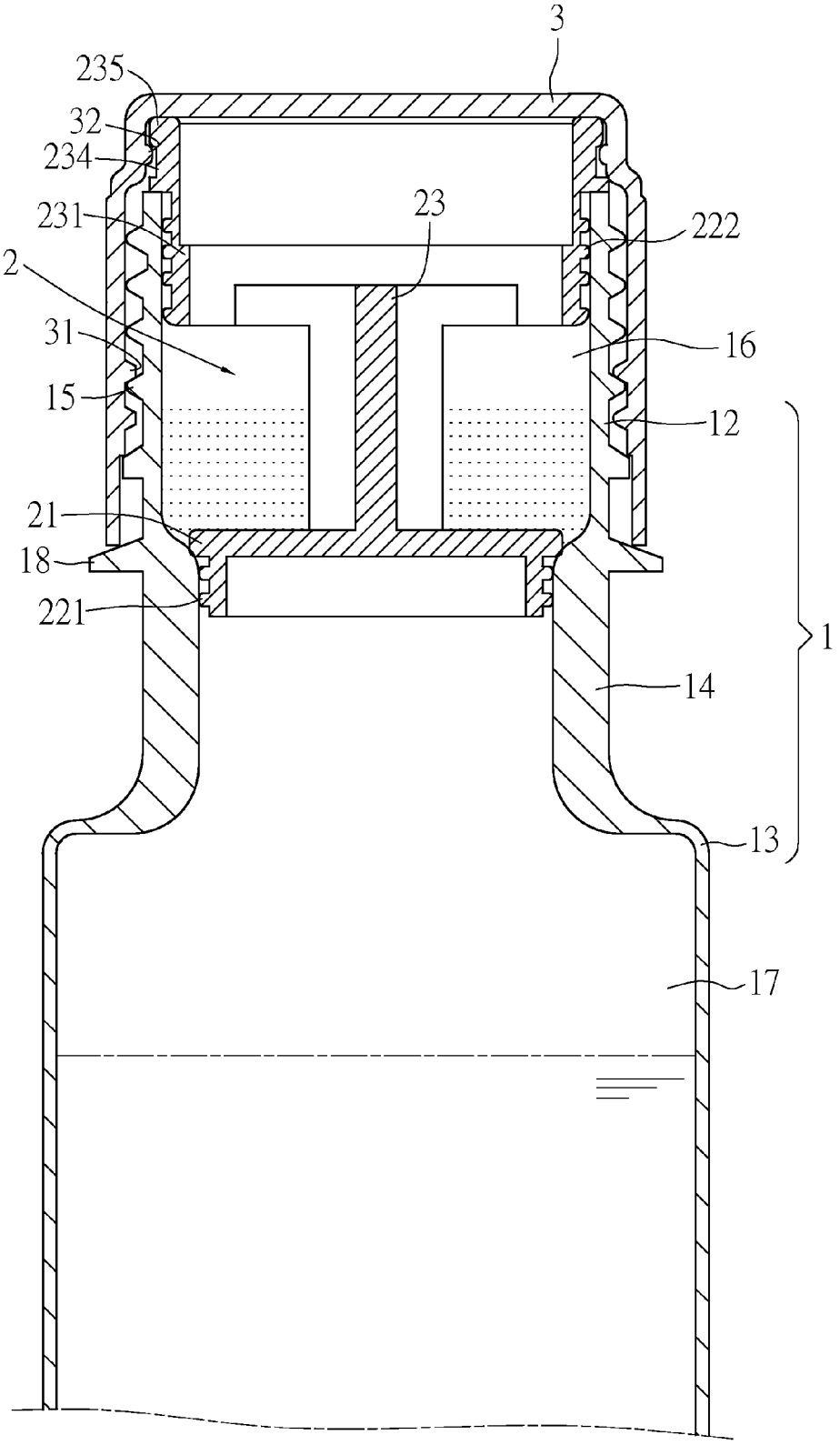
FIG. 3 is a sectional assembled view of the container according to the first embodiment of the present invention.

Please refer to FIGS. 1-3, illustrating a container for receiving two materials according a first exemplary embodiment of the present invention. The container for receiving two materials comprises a main body 1, a controlling member 2, and a bottle cap 3. The main body 1 is in the shape as a common cylindered bottle, and a receiving cavity 11 is defined in the main body 1. The main body 1 has a head segment 12 and a body segment 13 connected to the head segment 12. A neck segment 14 is formed between the head segment 12 and the body segment 13. The inner diameter of the neck segment 14 is less than the inner diameter of the head segment 12 and the inner diameter of the body segment 13. The head segment 12 has a first thread segment 15 configured to the outer periphery thereof. The first thread segment 15 is provided for threading with the bottle cap 3. The bottle cap 3 has a second thread segment 31 configured to the inner wall thereof to be threaded with the first thread segment 15.

Figure 6:
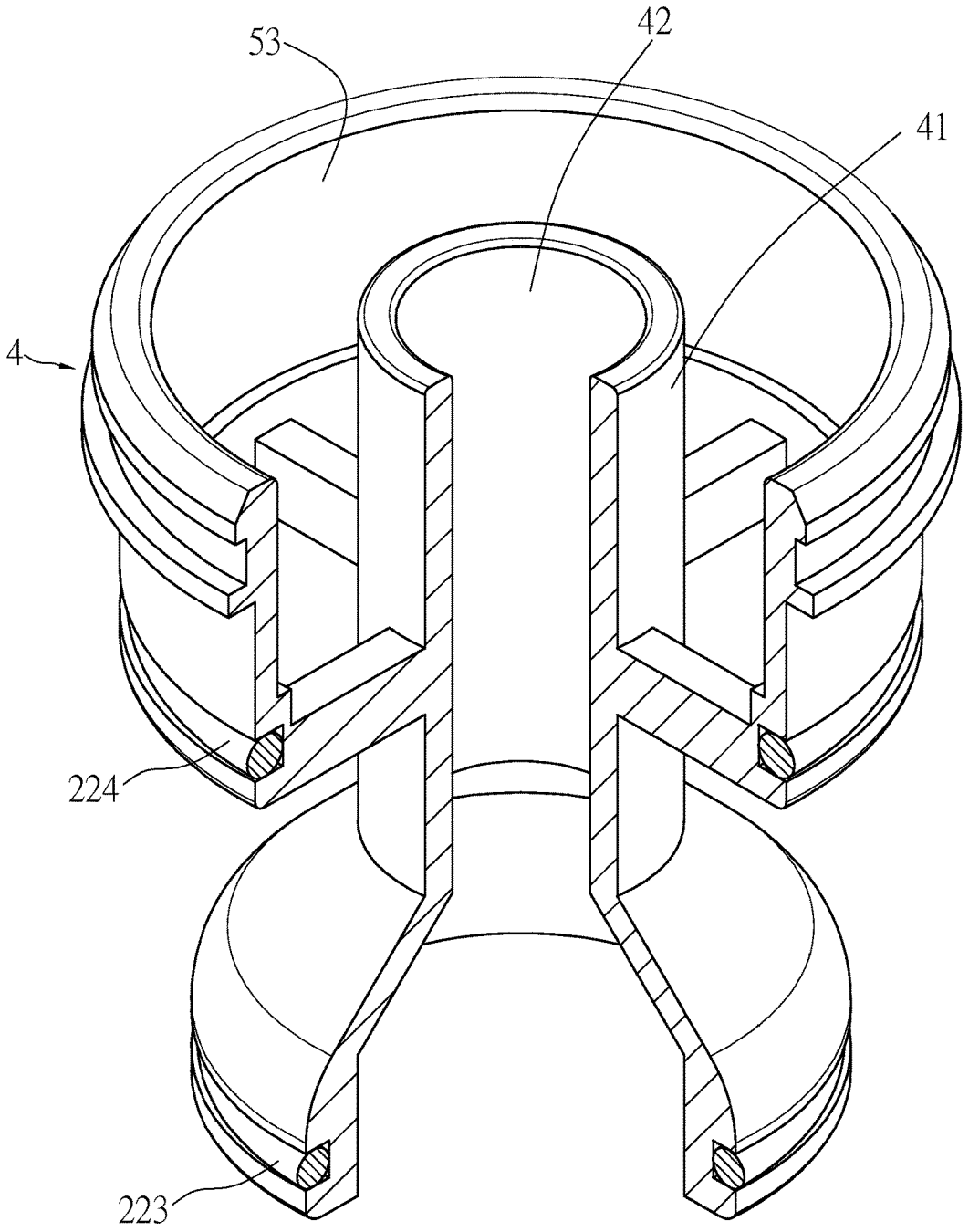
FIG. 6 is a partial sectional view of a controlling member of a container according to a second embodiment of the present invention.

The controlling member 22 has a sealing portion 21, and the outer diameter of the sealing portion 21 is mated with the inner diameter of the neck segment 14. In this embodiment, a soft ring 221 is integrally formed around the outer periphery of the sealing portion 21. A connecting portion 23, rod shaped, is standing on the sealing portion 21. The connecting portion 23 comprises an annular portion 231. The annular portion 231 is formed by extending the connecting portion 23 upward, and a soft ring 222 is integrally formed around the outer periphery of the annular portion 231 and is abutted against the inner wall of the head segment 12 to provide sealing for the head segment 12. Besides, an opening 232 is formed by the annular portion 231, and the connecting portion 23 and the annular portion 231 are connected via several ribs 233, so that the opening 232 is in communication with outside. Accordingly, the controlling member 2 is assembled in the head segment 12, and the sealing portion 21 is mated with the neck segment 14, so that the receiving cavity 11 is divided into an upper cavity 16 defined in the head segment 12 and a lower cavity 17 defined in the body segment 13, and the opening 232 is the exit of the upper cavity 16. In other words, the sealing portion 21 is closely abutted against the neck segment 14 via the ring 221. Alternatively, a seal ring 223, as shown in FIG. 6, may be coaxially fitted over the sealing portion 21, such that the sealing portion 21 is closely abutted against the neck segment 14 via the seal ring 223. Besides, a seal ring 224 may be coaxially fitted over the annular portion 231, so that the annular portion 231 is closely mated with the head segment 12. Base on this, the upper cavity 16 and the lower cavity 17 can be provided for receiving two different materials, and the materials inside the cavities would not mix with each other.

Additionally, the annular portion 231 further comprises an extension segment 235 extending from the head segment 12, and the bottle cap 3 is mated to the head segment 12 and abutted against the extension segment 235. As described, the bottle cap 3 and the head segment 12 are combined via thread patterns. In this embodiment, a flange 18 is radially protruded from the lower portion of the first thread segment 15 of the head segment 12. Under this arrangement, upon the bottle cap 3 being locked with the head segment 12, the position of the bottle cap 3 is regarded as the terminal position of the movement of the bottle cap 3 when the bottom of the bottle cap 3 is abutted against the flange 18. Besides, an engaging groove 234 is defined on the connecting portion 23 of the controlling member 2, and an engaging portion 32 is configured on the inner wall of the bottle cap 3. In this embodiment, the engaging groove 234 is defined around the outer periphery of the extension segment 235, and the engaging portion 32 is a protruded block protruded from the inner wall of the bottle cap 3 and located near the top of the bottle cap 3. Accordingly, upon the bottle cap 3 being locked with the head segment 12, the engaging portion 32 would gradually come closer to the engaging groove 234, and eventually the engaging portion 32 engages with the engaging groove 234. In other words, the bottle cap 3 and the controlling member 2 are combined as a whole.

Figure 4:
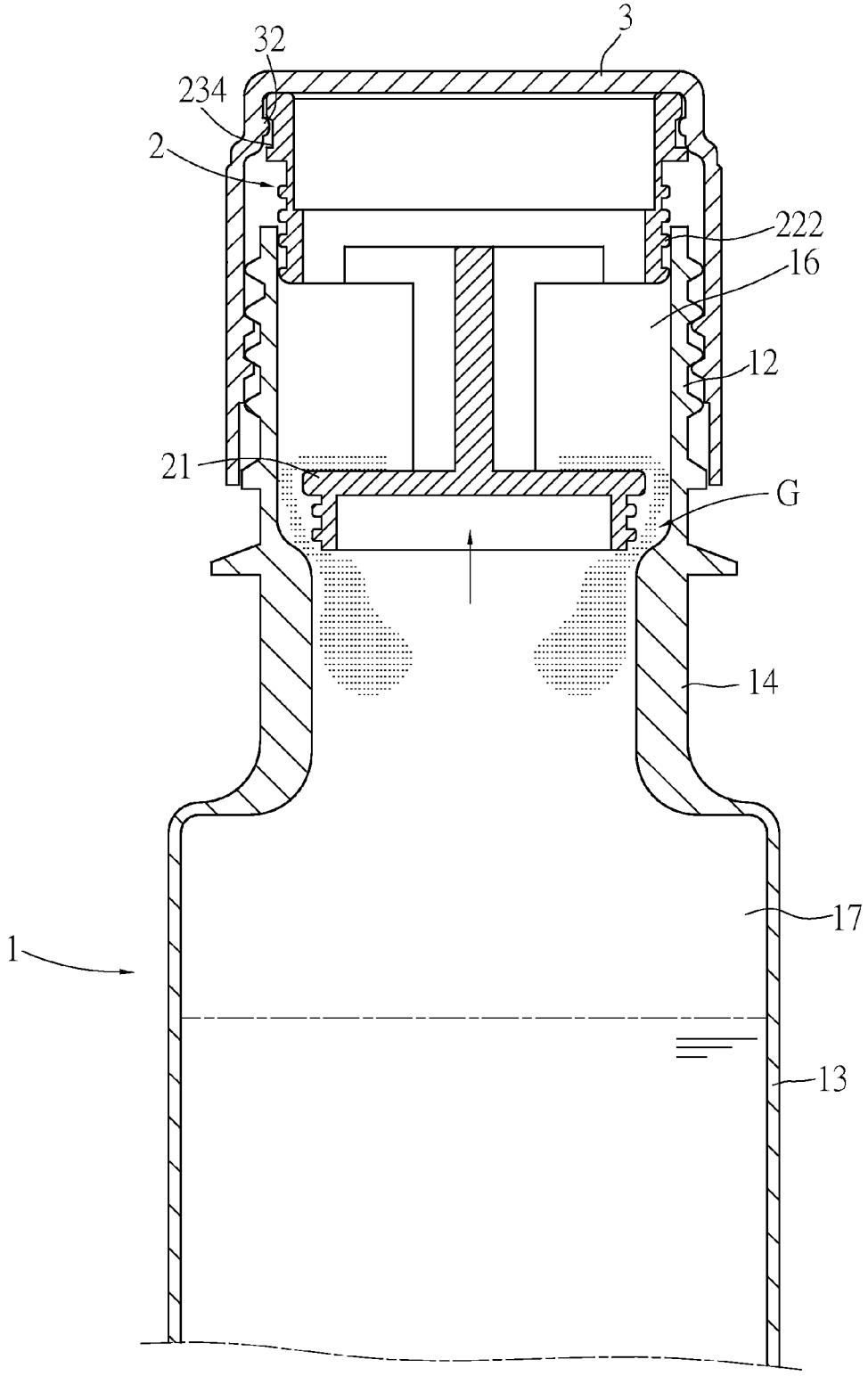
FIG. 4 is a schematic operational view (1) of the container according to the first embodiment of the present invention.
Figure 5:
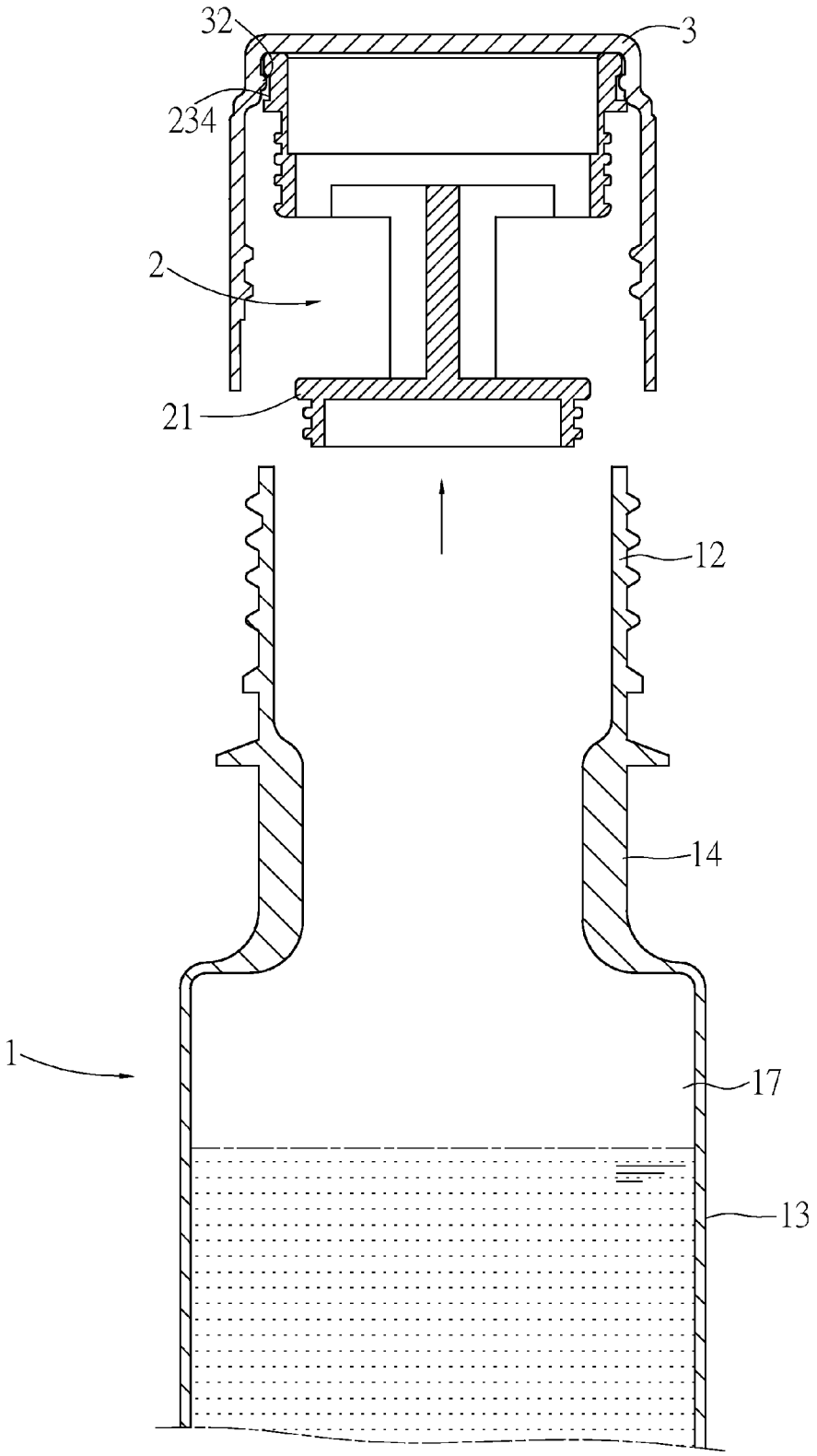
FIG. 5 is a schematic operational view (2) of the container according to the first embodiment of the present invention.

Next, after the bottle cap 3 and the controlling member 2 are combined, the controlling member 2 can be controlled via rotating the bottle cap 3 relative to the main body 1. Specifically, as shown in FIGS. 4-5, when the bottle cap 3 is loosed so as to be detached from the head segment 12, the controlling member 2 is moved along with the movement of the bottle cap 3. Therefore, the sealing portion 21 would detach from the neck segment 14, yet the ring 222 of the annular portion 231 is still abutted against the inner wall of the head segment 12. As a result, a gap G is thus generated between the upper cavity 16 and the lower cavity 17 to allow the two cavities communicating with each other, and the material inside the upper cavity 16 would fall into the lower cavity 17 and mix with the material inside the lower cavity 17. Accordingly, the materials can be mixed to produce the beverage within the bottle. Based on the above, when a user wants to drink the beverage inside the bottle, the user would operate the bottle cap 3 to allow the communication between the two cavities, and thus the two materials inside the bottle would be mixed with each other to produce the beverage. Accordingly, the freshness of the beverage can be ensured, and the beverage would not have a muddy outlook or participates before the mixing of the materials. Besides, during the mixing of the materials, the beverage would not leak out of the bottle.

In this embodiment, a stopping block 151 is configured to the first thread segment 15 of the head segment 12. When the bottle cap 3 is rotated to control the sealing portion 21 of the controlling member 2 detaching off the neck segment 14, the second thread segment 31 would encounter the stopping block 151 to slightly retard the rotation of the bottle cap 3, such that the user would be hinted that the sealing portion 21 is to be detached from the neck segment 14.

The advantages of the present invention are described as below. Because the controlling member 2 is configured in the head segment 12, the space in the head segment 12 can be provided for filling materials. Besides, the controlling member 2 has a proper length so as to reduce the manufacturing cost of the bottle and can be easily detached from the head segment 12. Moreover, since the upper cavity 16 is defined within the head segment 12, the bottle is in the shape as a common cylindered bottle, eliminating the doubt of the customers upon buying.

Figure 7:
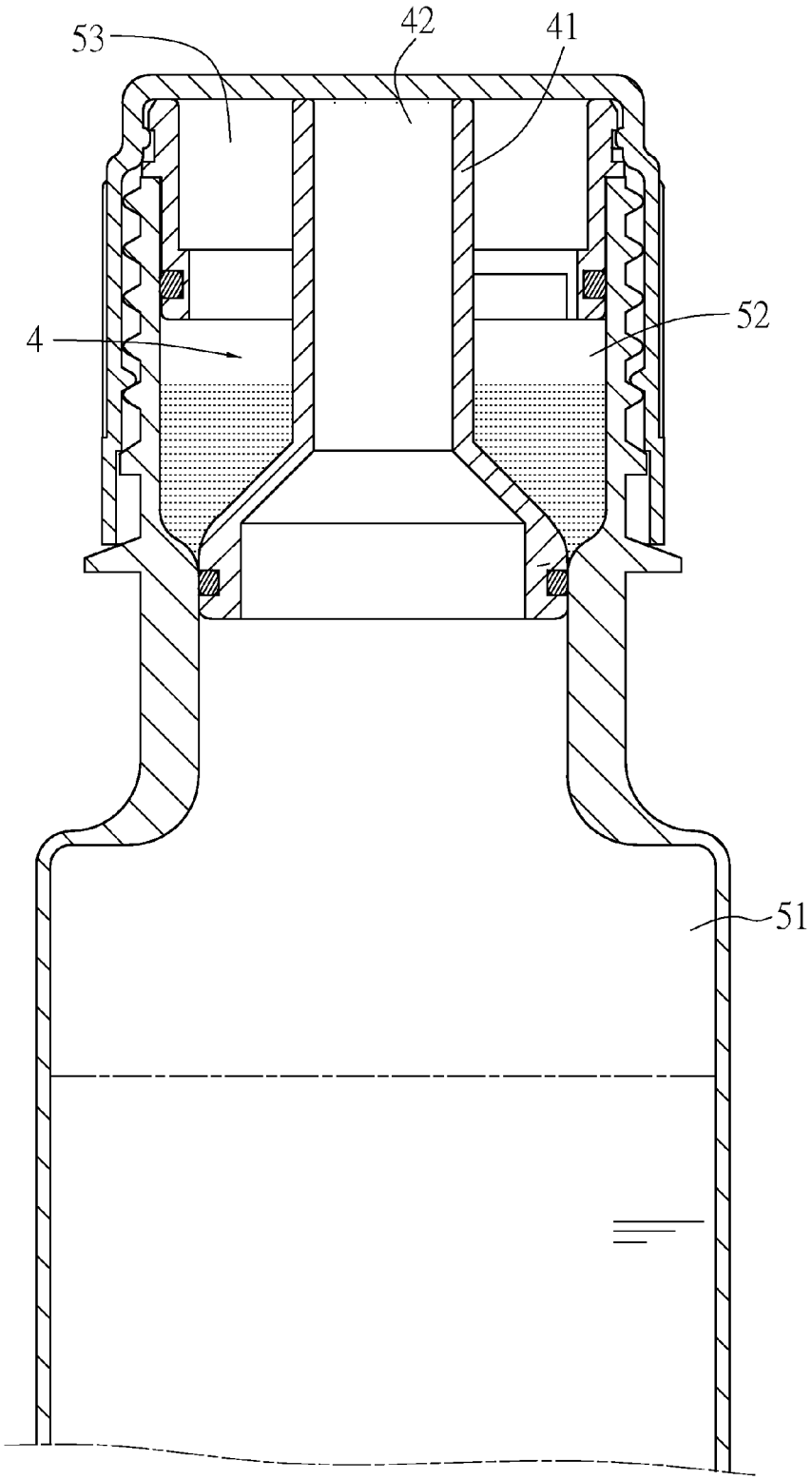
FIG. 7 is a sectional assembled view of the container according to the second embodiment of the present invention.

A second exemplary embodiment is provided as below. The structures between the first embodiment and the second embodiment are approximately the same, except the controlling member 4. As shown in FIG. 6, in the second embodiment, the connecting portion 41 of the controlling member 4 defines a channel 42 therethrough. Further refer to FIG. 7, the channel 42 communicates with the lower cavity 51 but not communicates with the upper cavity 52. In other words, the exit of the upper cavity 52 is the opening 53, and the exit of the lower cavity 51 is the channel 42. Therefore, materials can be fed into the cavities via the opening 53 and the channel 42, respectively.

Figure 8:
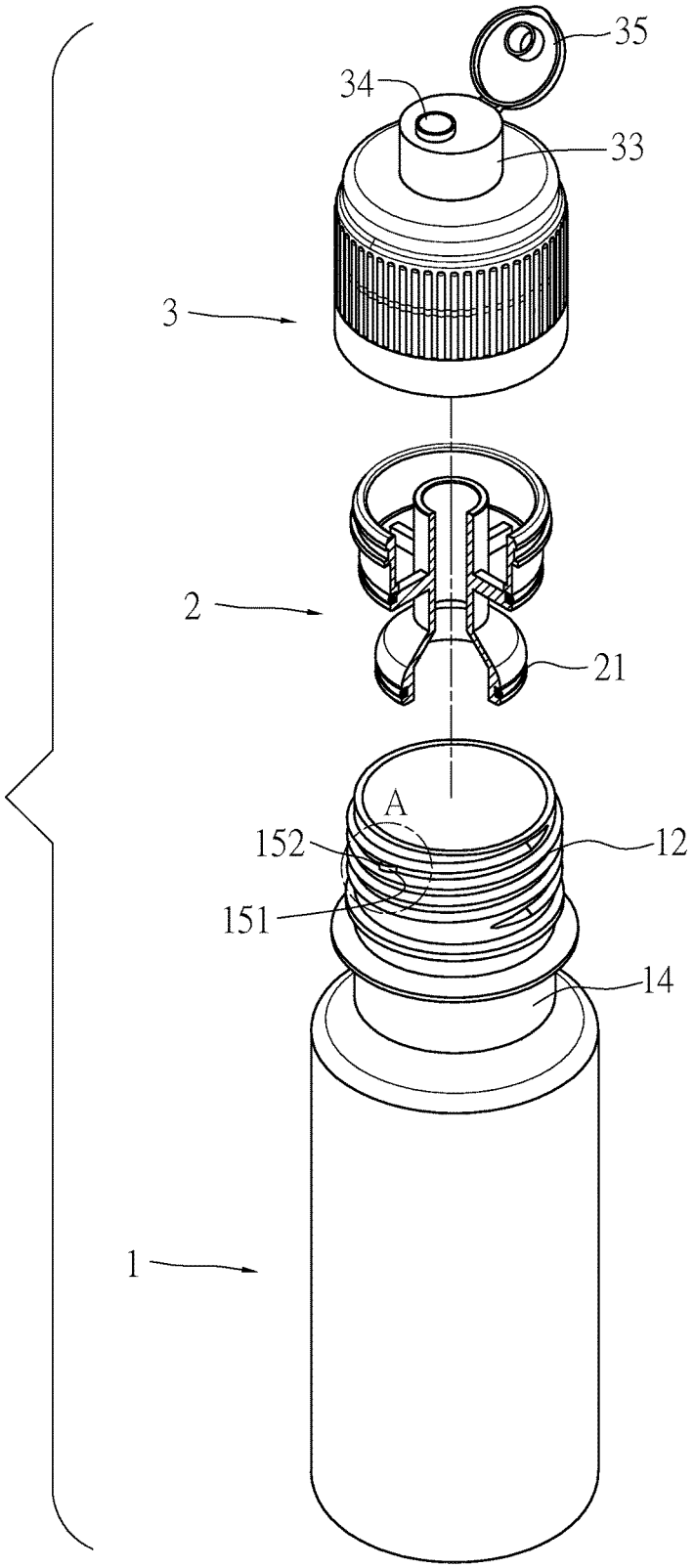
FIG. 8 is an exploded view of a container of according to a third embodiment of the present invention.

A third embodiment is provided as below, as shown in FIG. 8. The structures between the first and third embodiments are approximately the same, except the bottle cap 3. In the third embodiment, a tubular body 33 is standingly extending from the top of the bottle cap 3, and an opening 34 is formed on the top of the tubular body 33 to allow the communication inside the bottle cap 3 and outside the bottle cap 3. While a cover 35 is pivotally connected to the top of the bottle cap 3 to selectively open or close the opening 34.

Figure 9:
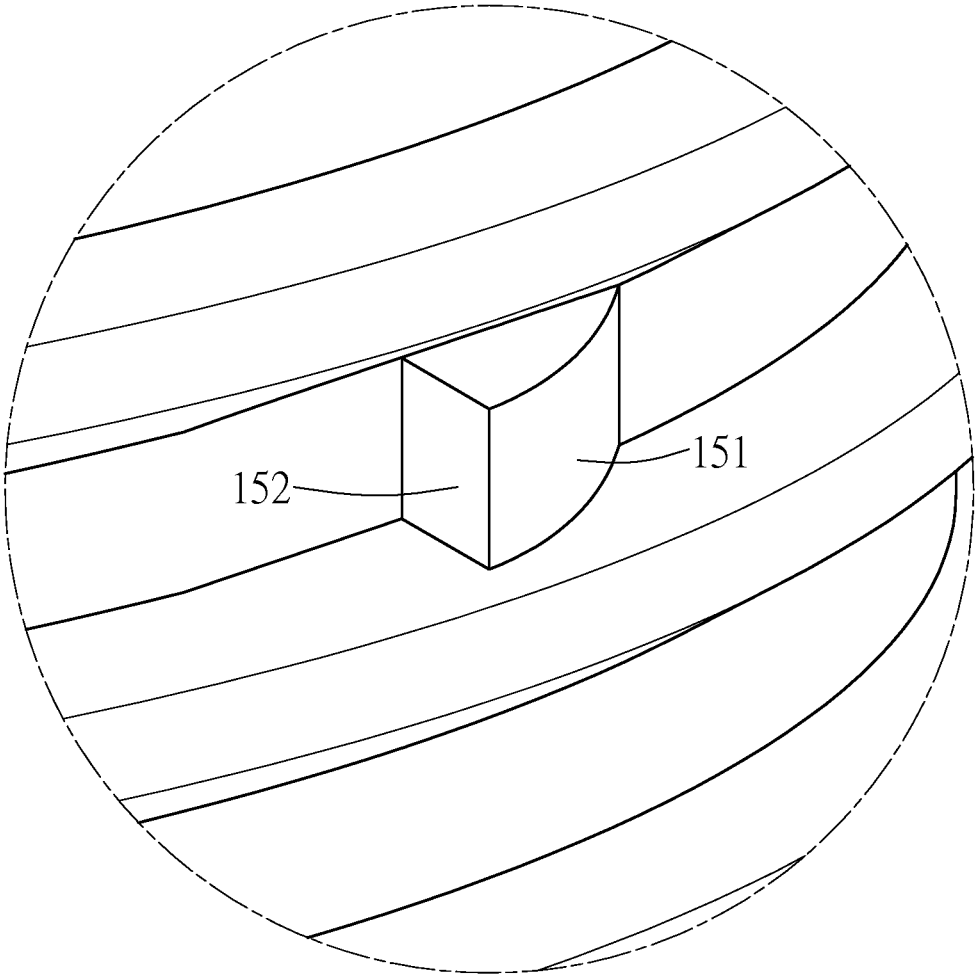
FIG. 9 is a partial enlarged view of the A portion shown in FIG. 8.

Furthermore, in the third embodiment, as shown in FIG. 9, the stopping block 151 has a stopping surface 152 parallel to the radial direction of the head segment 12. Therefore, upon a user rotates the bottle cap 3 to control the sealing portion 21 of the controlling member 2 to detach from the neck segment 14, the second thread segment 31 would encounter the stopping surface 152, and the bottle cap 3 can be hardly rotated relative to the head segment 12 to enabling the bottle cap 3 to be totally detached from the head segment 12. Under this arrangement, when the user wants to drink the beverage inside the bottle, the user can open the cover 35 to pour the beverage from the opening 34; or, the user can drink the beverage from the opening 34 directly.

Although particular embodiments of the invention have been described in detail for purposes of illustration, various modifications and enhancements may be made without departing from the spirit and scope of the invention. Accordingly, the invention is not to be limited except as by the appended claims.

The invention claimed is:

1. A container for receiving two materials, comprising:

a main body defining a receiving cavity therein, wherein the main body has a head segment and a body segment connected to the head segment, a neck segment is formed between the head segment and the body segment, an inner diameter of the neck segment is less than the an inner diameter of the head segment and an inner diameter of the body segment, the head segment has a first thread segment disposed on an outer periphery thereof;

a controlling member having a sealing portion, wherein an outer diameter of the sealing portion is mated with the inner diameter of the neck segment, a connecting portion is standing on the sealing portion, wherein when the sealing portion of the controlling member is mated with the neck segment, the receiving cavity is divided into an upper cavity and a lower cavity, the upper cavity is defined in the head segment, and the lower cavity is defined in the body segment; and a bottle cap configured to engage the head segment, wherein the bottle cap has a second thread segment disposed on an inner wall thereof to be threaded with the first thread segment, wherein an engaging groove is defined on the connecting portion of the controlling member, and an engaging portion is disposed on the inner wall of the bottle cap, the controlling member and the bottle cap are combined with each other by the an engagement between the engaging groove and the engaging portion, wherein when the controlling member is rotated along with the rotation of the bottle cap, the sealing portion is detached from the neck segment, thereby enabling communication between the upper cavity and the lower cavity.

2. The container for receiving two materials according to claim 1, wherein the connecting portion of the controlling member has an annular portion, an outer periphery of the annular portion is abutted against the inner wall of the head segment, and the annular portion further comprises an extension segment extending from the head segment, and the engaging groove is defined around an outer periphery of the extension segment.

3. The container for receiving two materials according to claim 2, wherein a seal ring is coaxially fitted over a circular member to provide sealing for the head segment.

4. The container for receiving two materials according to claim 2, wherein a soft ring is integrally formed around an outer periphery of a circular member to provide sealing for the head segment.

5. The container for receiving two materials according to claim 1, wherein a stopping block is configured to the first thread segment.

6. The container for receiving two materials according to claim 1, wherein a seal ring is coaxially fitted over the sealing portion of the controlling member to provide sealing for the neck segment.

7. The container for receiving two materials according to claim 1, wherein a soft ring is integrally formed around the outer periphery of the sealing portion of the controlling member to provide sealing for the neck segment.

8. The container for receiving two materials according to claim 1, wherein the connecting portion of the controlling member defines a channel therethrough, the channel communicates with the lower cavity but does not communicate with the upper cavity.

9. The container for receiving two materials according to claim 1, wherein the bottle cap defines an opening.

10. The container for receiving two materials according to claim 9, wherein a tubular body is standingly extending from the top of the bottle cap, and the opening is formed on the top of the tubular body.

* * * * *